US006318739B1

(12) United States Patent
Fehn, Jr.

(10) Patent No.: US 6,318,739 B1
(45) Date of Patent: Nov. 20, 2001

(54) SUSPENSION FOR A SKATEBOARD

(76) Inventor: Albert Lucien Fehn, Jr., 5042 Winkle Ave., Santa Cruz, CA (US) 95065

( * ) Notice: Subject to any disclaimer, the term of this patent is extended or adjusted under 35 U.S.C. 154(b) by 0 days.

(21) Appl. No.: 09/578,478

(22) Filed: May 26, 2000

Related U.S. Application Data

(60) Provisional application No. 60/136,407, filed on May 27, 1999.

(51) Int. Cl.[7] ..... A63C 17/02

(52) U.S. Cl. ..... 280/11.28; 280/11.27; 280/11.223; 280/11.225; 280/87.042

(58) Field of Search ..... 280/841, 11.19, 280/11.27, 11.28, 11.223, 11.225, 87.042, 87.041

(56) References Cited

U.S. PATENT DOCUMENTS

| | | | | |
|---|---|---|---|---|
| 4,055,234 | * | 10/1977 | Burton | 188/2 |
| 4,062,557 | * | 12/1977 | Roden | 280/87.04 |
| 4,089,536 | * | 5/1978 | Larruceau | 280/11.28 |
| 4,109,925 | * | 8/1978 | Williams et al. | 280/11.28 |
| 4,127,282 | | 11/1978 | Gorlach et al. | 280/87.04 |
| 4,155,565 | * | 5/1979 | de Caussin et al. | 280/87.04 |
| 4,180,278 | | 12/1979 | Gottlieb | 280/87.04 |
| 4,184,693 | * | 1/1980 | Whitmarsh | 280/11.28 |
| 4,394,037 | * | 7/1983 | Kuntz | 280/816 |
| 4,398,735 | * | 8/1983 | Evans et al. | 280/11.28 |
| 4,817,974 | | 4/1989 | Bergeron | 280/11.2 |
| 5,114,166 | * | 5/1992 | McCosker | 280/87.042 |
| 5,127,672 | | 7/1992 | Horibata | 280/842 |
| 5,143,388 | | 9/1992 | Chen | 280/11.28 |
| 5,263,725 | * | 11/1993 | Gesmer et al. | 280/11.28 |
| 5,330,214 | * | 7/1994 | Brooks et al. | 280/87.042 |
| 5,492,352 | | 2/1996 | St. Clair | 280/87.042 |
| 5,522,620 | * | 6/1996 | Pracas | 280/87.041 |
| 5,707,068 | | 1/1998 | Bradfield | 280/87.042 |
| 5,826,895 | | 10/1998 | Bradfield | 280/87.042 |
| 5,868,408 | * | 2/1999 | Miller | 280/87.042 |
| 5,997,018 | * | 12/1999 | Lee | 280/87.042 |
| 6,182,987 | * | 2/2001 | Bryant | 280/87.042 |
| 6,224,076 | * | 5/2001 | Kent | 280/87.042 |

FOREIGN PATENT DOCUMENTS

| | | |
|---|---|---|
| 0 558 776 A1 | 9/1993 | (EP) . |
| 2435958 | 5/1980 | (FR) . |
| 1029590 | 5/1966 | (GB) . |

* cited by examiner

*Primary Examiner*—J. J. Swann
*Assistant Examiner*—J. Allen Shriver
(74) *Attorney, Agent, or Firm*—Richard C. Litman

(57) ABSTRACT

A suspension assembly for a skateboard is disclosed having a base plate with a truck plate pivotally attached at one end. A shock absorber is located between the base plate and the truck plate. A projection on the base plate protects the shock absorber and aids the rider in performing tricks. In use, a wheel truck is attached to the truck plate opposite the shock absorber. The suspension assembly provides a suspension for a skateboard which helps to protect the rider from bumps, while retaining good steering control. In another embodiment of the invention, the suspension assembly includes a base plate with a projection at each end. Each projection has a groove and a top out stop. A truck plate is biased away from the base plate by a shock absorber, with the ends of the truck plate sliding in the grooves. Also part of the invention is a skateboard incorporating a pair of suspension assemblies.

16 Claims, 7 Drawing Sheets

SUSPENSION FOR A SKATEBOARD

CROSS-REFERENCE TO RELATED APPLICATION

This application claims the benefit of U.S. Provisional Patent Application Ser. No. 60/136,407, filed May 27, 1999.

BACKGROUND OF THE INVENTION

1. Field of the Invention

The present invention relates to skateboards and to suspensions therefor.

2. Description of Related Art

Typical skateboards have a platform and two wheel trucks, with one truck mounted near the nose and the other near the tail of the platform. Each truck includes a set of polyurethane wheels mounted on a body. The wheels typically have a diameter of about 2 inches, a width of about 1 ½ inches, and are set 5 inches apart. The truck includes a joint and a pivot pin, which allow the board to be steered. Steering is done by lateral weight shifts by the rider, which tilt the platform. The truck typically includes elastomeric members to absorb some of the shock and to allow adjustment of the steering. The following related art patents reflect the current state of the art, but do not disclose or suggest the instant invention, an improved skateboard suspension system.

U.S. Pat. No. 4,127,282 to Gorlach et al. discloses a skate board vehicle having front and rear wheel and axle supports. Each support includes a supporting bearing block with a slide element. A pivot pin with an axle support pivotally mounts the axle and wheels. A brake assembly includes a coil spring. The brake is weight-activated.

U.S. Pat. No. 4,180,278 to Gottlieb teaches a skateboard having integrally molded flange members to which wheel support members are attached. The flange members and wheel support members have complementary recessed portions containing a block of shock absorbing material.

U.S. Pat. No. 4,817,974 to Bergeron discloses a roller skate or skateboard having an auxiliary wheel located above the ground and behind the rear wheels. The auxiliary wheel is mounted on a lever arm which is pivotally connected at one end to the base member of the skate or skateboard. A spring member biases the lever arm away from the base member.

U.S. Pat. No. 5,114,166 to McCosker discloses a wheeled coasting board having carriage assemblies supported by springs. U.S. Pat. No. 5,127,672 to Horibata discloses a hopping roller skate having a shoe supported by a pair of coil springs attached to a wheeled roller skate body. U.S. Pat. Nos. 5,707,068 and 5,826,895 to Bradfield discloses an in-line skateboard which may have its rear wheels mounted in a coil and leaf spring suspension. U.S. Pat. No. 5,492,352 to St. Clair teaches a roller board with a flat board member and sequentially aligned, removable wheels.

U.S. Pat. No. 5,143,388 to Chen teaches a skate truck for a skateboard having a flexible V-shaped beam. A peg is connected to a buffer to absorb shock.

U.S. Pat. No. 5,263,725 to Gesmer et al. discloses a skateboard truck assembly having a yoke with a pivot pin. A spring assembly functions to improve fine steering control and rebound the wheels to the straight-ahead position.

U.S. Pat. No. 5,868,408 to Miller discloses a turf board having wheel assemblies with each tire independently attached to the platform. Each wheel assembly has a hinge plate with two lever arms and two shock absorbers.

British Patent No. 1,029,590 to Smith discloses a wheeled vehicular device having two wheel groups mounted on supports. Each support is pivotally mounted by a ball-and-socket joint.

French patent document No. 2,435,958 teaches a suspension unit for a skate board having a support chassis mounted on the board. A connecting frame is hinged to the support chassis. A suspension spring is positioned between the support chassis and the shock absorber.

European Patent Application No. 0 558 776 A1 discloses a truck for a skateboard having a suspension beam which acts as a shock absorber. An elastomeric member acts as a supplementary shock absorber.

None of the above inventions and patents, taken either singly or in combination, is seen to describe the instant invention as claimed.

SUMMARY OF THE INVENTION

The present invention is a suspension assembly for a skateboard. The suspension assembly includes a base plate with a truck plate pivotally attached at one end. A shock absorber is located between the base plate and the truck plate. A projection on the base plate protects the shock absorber and aids the rider in performing tricks. In use, a wheel truck is attached to the truck plate opposite the shock absorber. The suspension assembly provides a suspension for a skateboard which helps to protect the rider from bumps, while retaining good steering control. In another embodiment of the invention, the suspension assembly includes a base plate with a projection at each end. Each projection has a groove and a top out stop. A truck plate is biased away from the base plate by a shock absorber, with the ends of the truck plate sliding in the grooves. Also part of the invention is a skateboard incorporating a pair of suspension assemblies.

Accordingly, it is a principal object of the invention to provide a suspension assembly for a skateboard having a base plate, a truck plate, a shock absorber, and a wheel truck.

It is another object of the invention to provide a suspension assembly having a projection to protect the shock absorber.

It is a further object of the invention to provide a suspension assembly which protects a skateboard rider from bumps and helps to prevent injury.

Still another object of the invention is to provide a suspension assembly which enhances a rider's ability to perform tricks.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
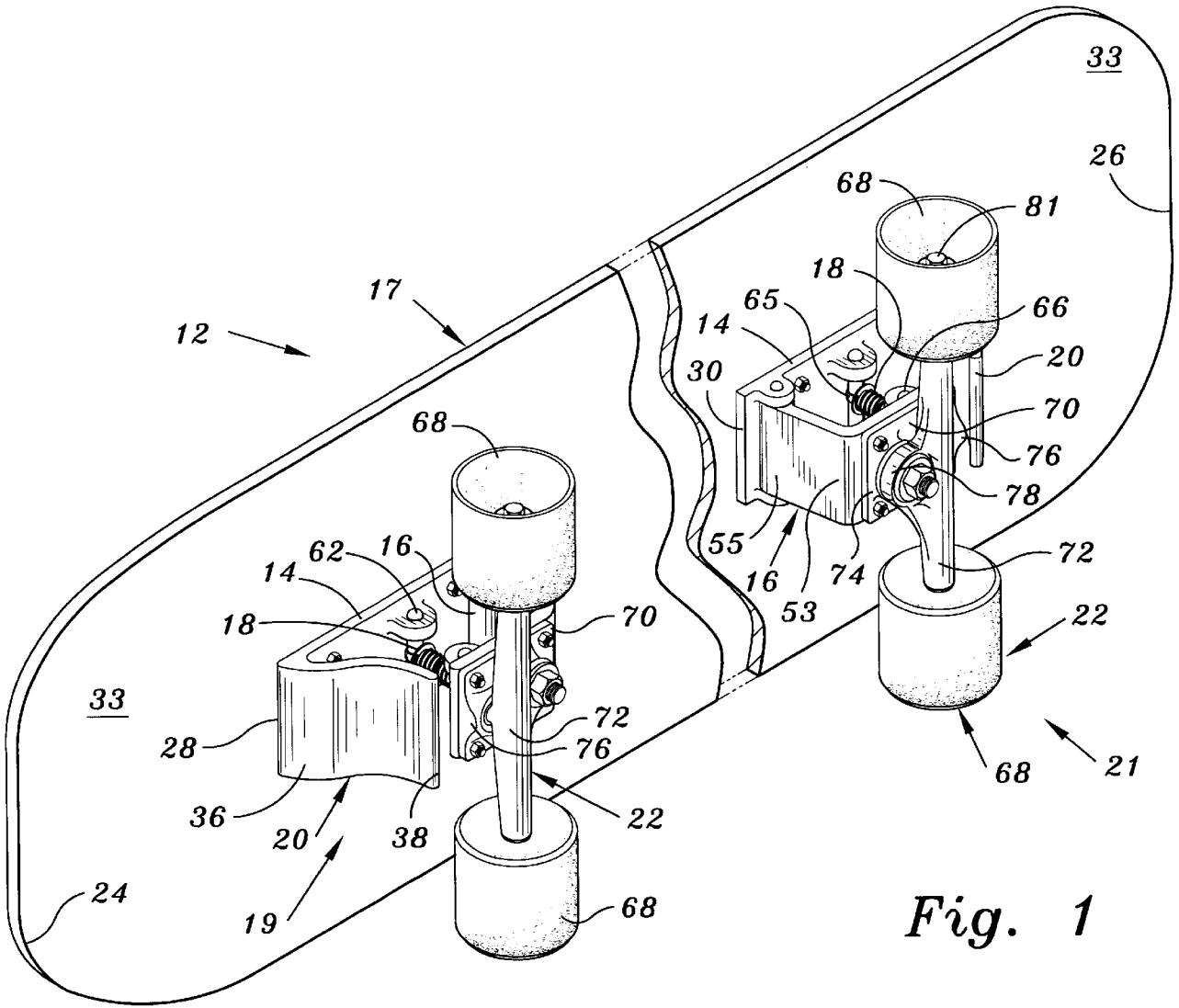
FIG. 1 is an environmental, perspective view of a skateboard with attached suspension assemblies.

The present invention is a suspension assembly 10 for a skateboard 12. In one embodiment of the invention, the suspension assembly 10 includes a base plate 14 and a truck plate 16 pivotally attached to the base plate 14. See FIG. 1. A shock absorber 18 is located between the base plate 14 and the truck plate 16. The base plate 14 attaches to the platform 17 of the skateboard 12. The base plate 14 has at least a first projection 20. A wheel truck 22 is attached to the truck plate 16 opposite the shock absorber 18.

The platform 17 is of conventional construction. The platform has a front end 24 and a tail end 26. Both the front end 24 and the tail end 26 are generally curved upward at least slightly, as shown in FIG. 1. The tail end often has a greater curve, giving leverage for performing stunts. A typical platform is about 10 inches wide and 30 inches long. The platform may be constructed of wood, fiberglass, or other suitable materials. The front suspension assembly 19 is located near the front end 24. The rear suspension assembly 21 is located near the tail end 26. A typical distance between the suspension assemblies is about 18 inches. See FIG. 1.

The base plate 14 has a first end 28, a second end 30, and a central section 32. See FIGS. 2 and 3. The base plate 14 is preferably composed of steel or aluminum, a durable plastic, or a composite. Stamped sheet metal may be used. The dimensions of the base plate may vary. An example of a suitable width is about 3 inches.

The central section 32 of the base plate 14 is planar or generally planar. The base plate is attached to the bottom surface 33 of the platform 17. Preferably the base plate is attached to the platform by at least two bolts 35. See FIG. 2. If additional stability is desired, extra bolts may be used to attach one or both of the first or second ends 28 or 30 to the platform. The bolts preferably include a rubber washer or rubber lining, to limit noise and to prevent the bolts from vibrating out of the holes. The bolts 35 extend through the platform 17 and are fastened by nuts 39.

Preferably the central section 32 is attached to the platform by four bolts 35. Each set of four bolts is placed in one of the two sets of standard pre-drilled mounting holes of the skateboard. The truck plate and base plate preferably include at least four corresponding mounting holes for mounting to the platform. Six mounting holes are preferred in the truck plate and the base plate for additional flexibility in mounting.

The first projection 20 is located at or near the first end 28 of the base plate. See FIGS. 1, 2, 3, 5, and 8. The first end 28 of the base plate may extend beyond the first projection if desired. Any such extension is preferably minimal to avoid adding unnecessary weight to the suspension assembly. The projection protects the shock absorber from blows to the side and increases its durability. This is particularly important in performing tricks, in which the ends of the suspension assembly may be used for balancing on objects.

The first projection 20 has an inner edge 34 and an opposite outer edge 36. See FIGS. 2–6. The first projection also has a base end 37 and a projecting end 38. The base end 37 of the first projection is attached to the first end 28 of the base plate. Preferably the first projection is integral with the first end of the base plate.

Figure 2:
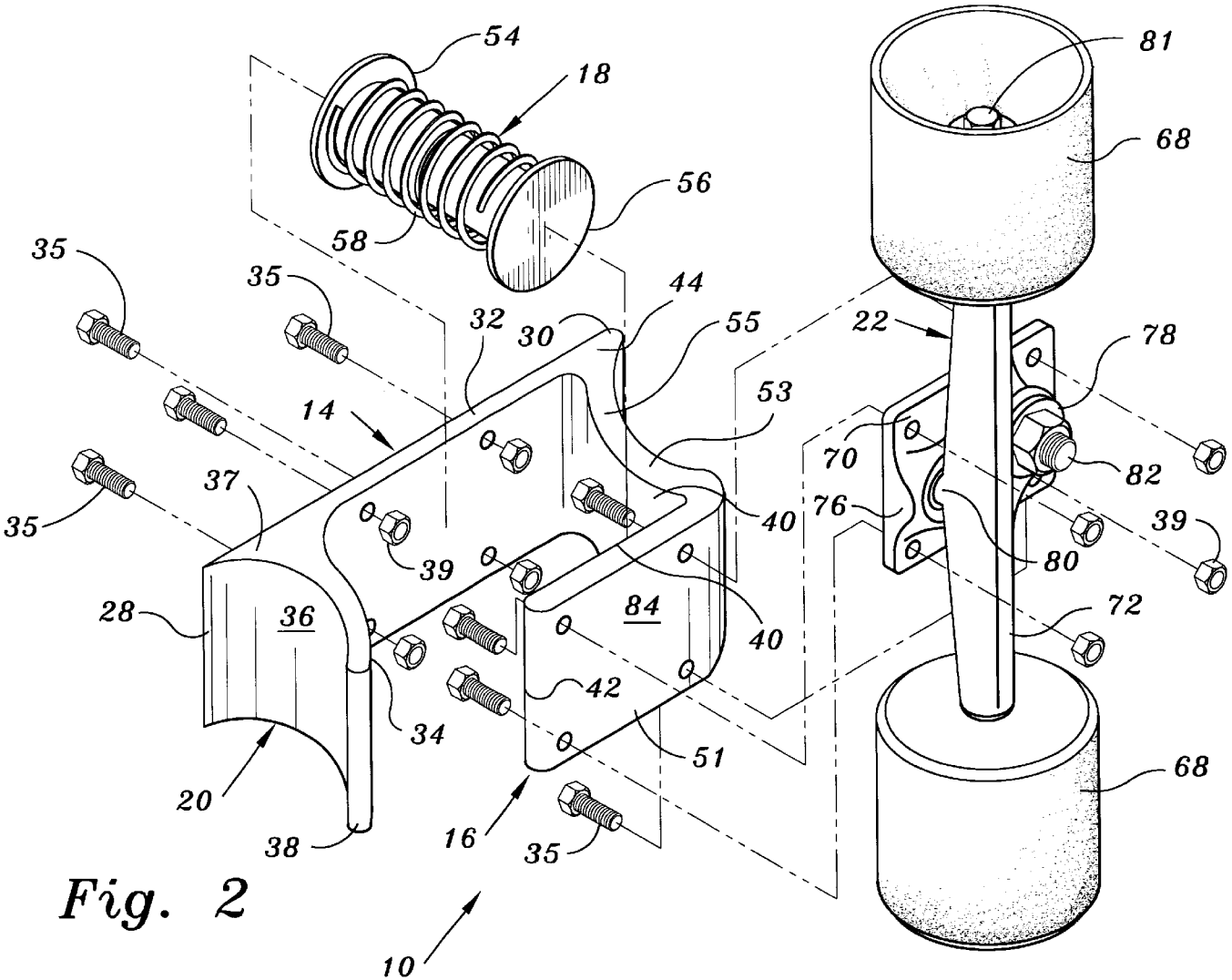
FIG. 2 is an exploded view of a suspension assembly.
Figure 4:
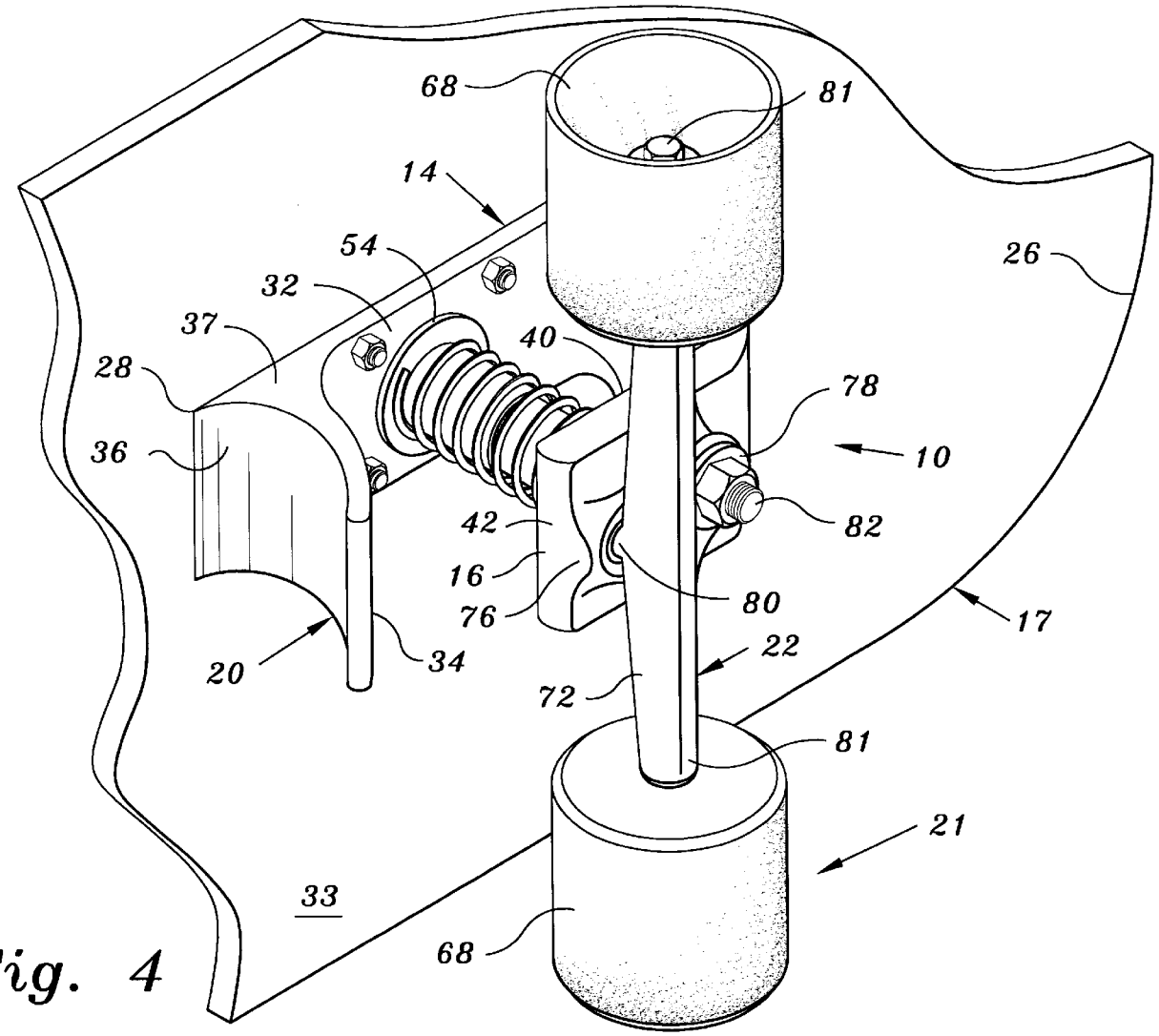
FIG. 4 is a perspective view of a suspension assembly having the body of the truck integrally attached to the truck plate.
Figure 6:
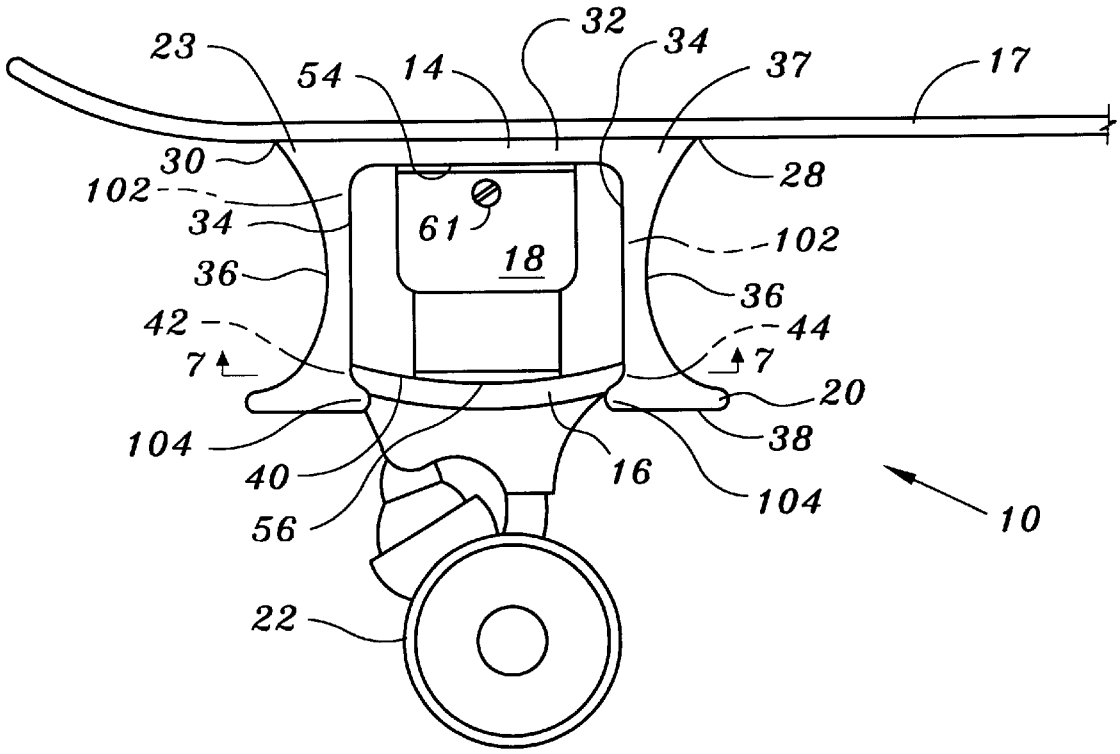
FIG. 6 is a side view of a suspension assembly.
Figure 8:
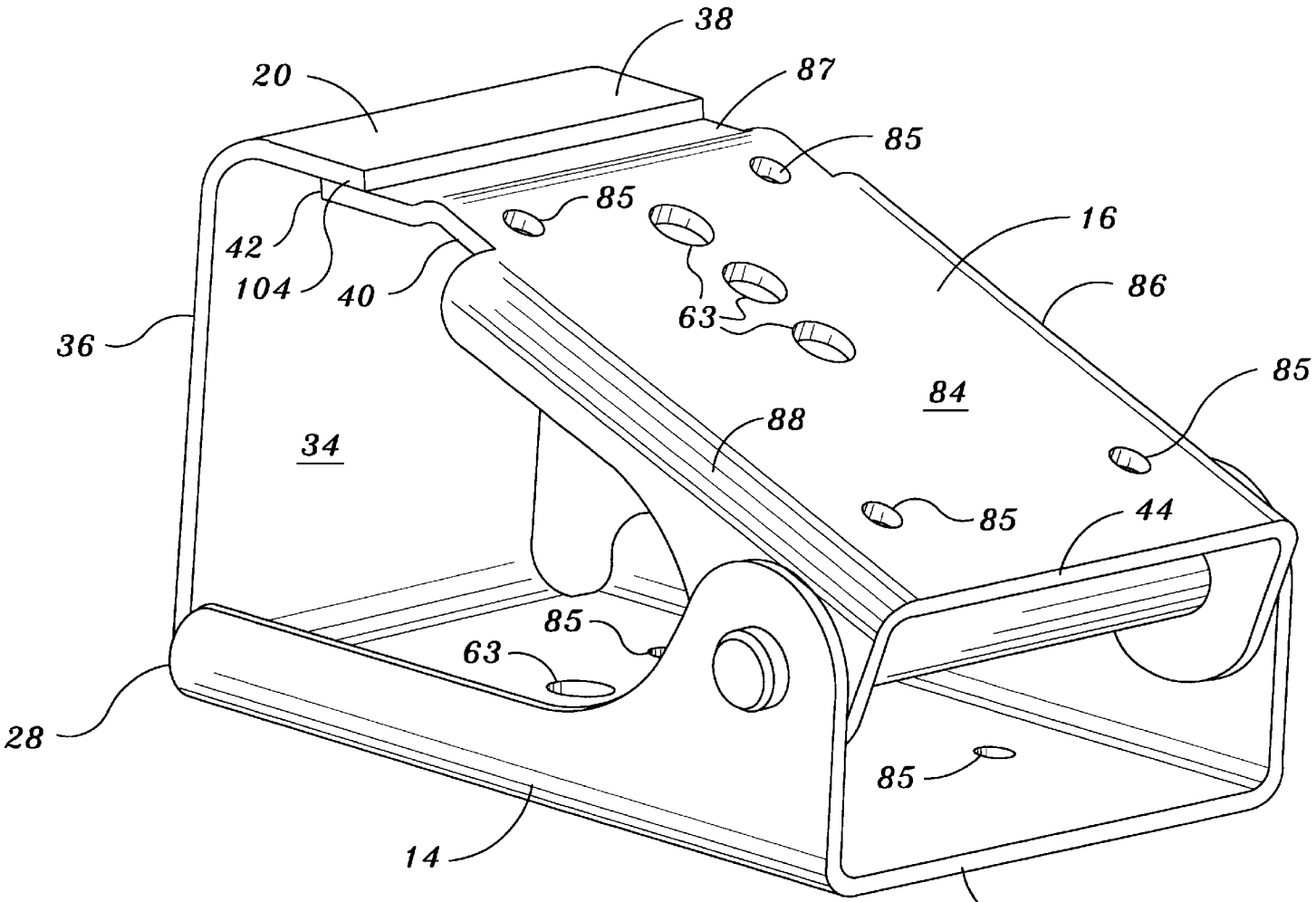
FIG. 8 is a perspective, detail view of a base plate, truck plate, and projection.

The first projection 20 may have a variety of shapes. The first projection 20 may be perpendicular to the platform 17. The outer edge 36 of the first projection may be arc-shaped and concave, as shown in FIGS. 2, 4, and 6. The outer edge may be sized to conform to a typical steel railing or to the edge of a concrete curb. This increases the security with which tricks and stunts on railings and curbs may be performed. Alternatively, the outer edge may have a larger size to conform to the rounded concrete coping typically found on edges in skateboard parks. This also increases the security of the rider in performing stunts on pipes and other surfaces in skateboard parks. The outer edge may also be straight, as shown in FIG. 8.

Ideally the first projection is a ridge extending the full width or substantially the full width of the base plate. Alternatively, the first projection may consist of one or more posts placed to protect the shock absorber. A suitable length is for the projecting end to extend about 2 inches from the platform.

In a preferred embodiment, the first projection is a simple piece of stamped sheet metal. The projecting end 38 may be bent in a flat curve toward the truck plate, forming a top out stop 104. See FIG. 8. The second end 42 of the truck plate extends far enough to contact the top out stop. The second end 42 is between the base plate 14 and the top out stop 104. The top out stop restrains the motion of the truck plate and prevents the biasing means of the shock absorber from extending the truck plate too far away from the platform 17.

In the embodiments of FIGS. 1–5 and 8, the truck plate 16 has an inner surface 40, a second end 42, and a first end 44. The truck plate is preferably composed of steel or aluminum, but may be molded of a plastic or a composite material. Stamped sheet metal may be used. The dimensions of the truck plate may vary. A suitable width is about 2 ¾ inches.

The second end 42 of the truck plate is located near the first projection 20. The second end 42 preferably extends a slightly smaller distance from the base plate than the projecting end 38 of the first projection; this provides optimal protection for the shock absorber 18. As noted above, the projection may include a top out stop for the truck plate. However, care must be taken that the first projection 20 does not extend so far that it bottoms out on bumps.

The first end 44 of the truck plate 16 is pivotally connected to the base plate 14 near the second end 30 of the base plate. On hitting a bump, the second end 42 travels in an arc toward the base plate, then rebounds back. Preferably the second end 42 remains near the first projection 20 throughout its travel. This assures that the gap between the first projection 20 and the second end 42 is as small as possible without actual contact. Having only a small gap prevents objects from being forced through the gap. Note that in the embodiment of FIG. 5, the second end 42 is also pivotally connected to the base plate.

Figure 3:
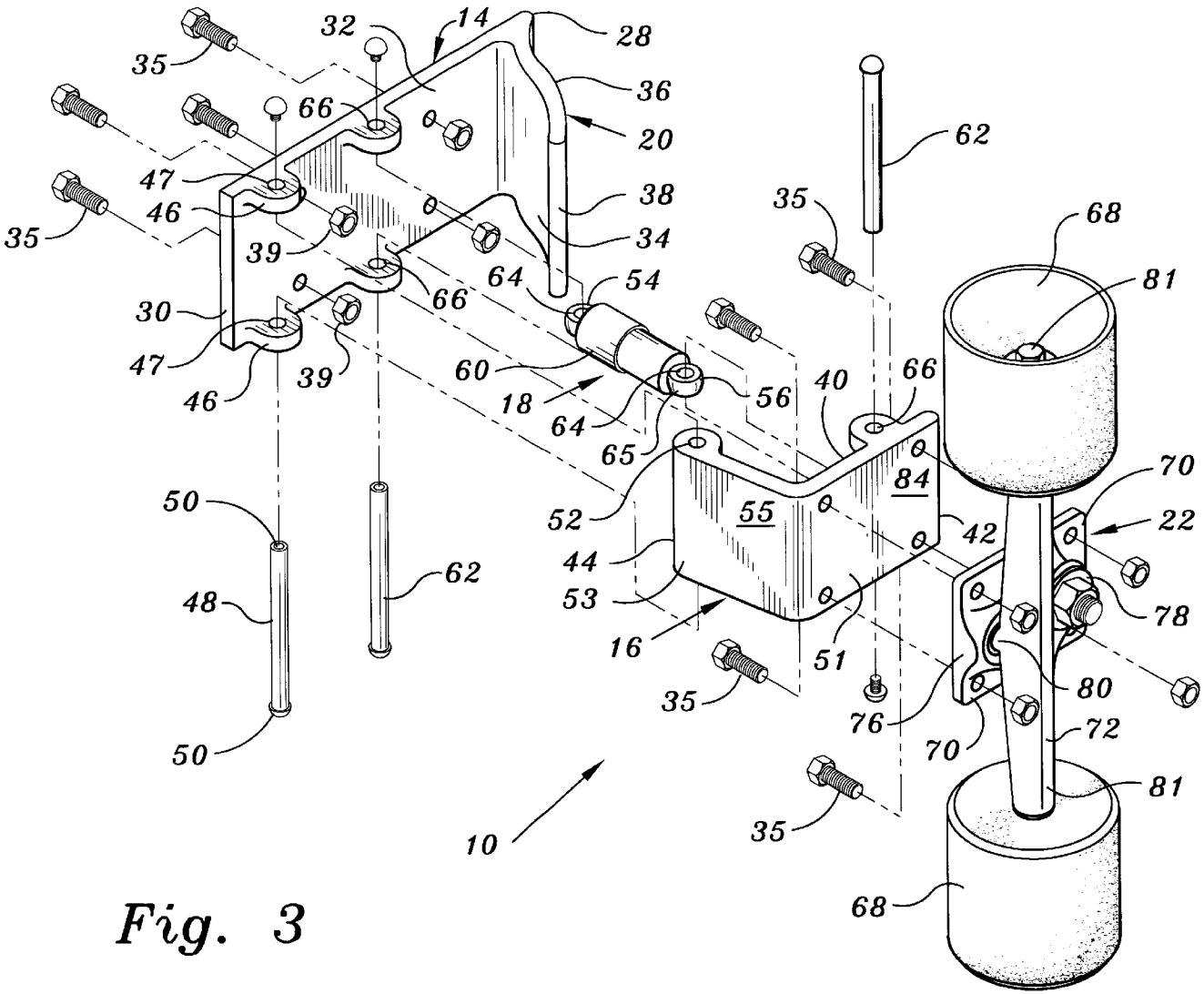
FIG. 3 is an exploded view of an alternative suspension assembly.

The connection of the truck plate to the base plate may include a hinge mechanism, as shown in FIGS. 1, 3, and 8. Alternatively the first end of the truck plate may be integrally connected to the second end 30, with sufficient flexibility at the connection to form a living or self hinge. See FIG. 2. The living hinge is less expensive to manufacture, but is also less durable.

The hinge mechanism, if used, may have several different configurations. An example is shown in FIG. 3. The base plate 14 may include two hinge ears 46 near the second end 30. Each hinge ear has a hinge ear aperture 47. The first end 44 of the truck plate 16 includes a corresponding hinge pin 48. The hinge pin 48 has two ends 50. The hinge pin 48 passes through one or more first end apertures 52 in the first end 44. Each hinge ear 46 is pivotally connected to one of the ends 50 of the hinge pin 48. This allows the truck plate to turn freely on the hinge mechanism, with the second end 42 traversing an arc. The truck plate may also have a set of hinge ears for attachment to the base plate, as shown in FIG. 3.

While aluminum may be used for the base plate and the truck plate, aluminum wearing against aluminum tends to become sticky with use. Steel is therefore preferred for the hinge mechanism itself. If aluminum is used in the hinge mechanism, the actual contact points such as bushings or bearings are preferably composed of steel.

The hinge pin 48 may have various designs. The hinge pin may include a set screw or set pin to hold the hinge pin in position. The hinge pin may have its ends 50 threaded on the exterior or the interior. A nut or bolt may be used on exterior threads to attach the hinge pin. The hinge pin may also be a fixed pin sandwiched between the hinge ears or in a notch in the base plate. A rubber lining or washer may be used with the nut or bolt to prevent loosening due to vibration.

In one preferred embodiment, the truck plate has a first section 51 and a second section 53. See FIGS. 2–3. The first section 51 is preferably parallel to or at only a slight angle to the platform 17. The second section 53 extends at an angle to the first section 51. Preferably the angle between the first and second sections is greater than 90 degrees and most preferably ranges from about 105 degrees to about 145 degrees. The angled truck plate places the shock absorber in a good position to absorb shock while skateboarding.

The dimensions of the sections may vary. In a preferred arrangement, the first section has a length of about 3 to 3 ½ inches and a width of 2 to ½ inches. This provides sufficient room to attach a standard truck.

The second section 53 of the truck plate has an outer edge 55, as shown in FIGS. 1, 2, and 3. The outer edge of the second section may be concave, as shown in FIG. 2. The concave outer edge may be sized to conform to a typical railing, curb, or coping, just as for the outer edge of the first projection 20. If the outer edges of both the first projection and the second section are concave, stunts can be done using either edge of the suspension, allowing for a greater variety of stunts.

In another preferred embodiment, the truck plate is generally planar. See FIG. 8. The edges of the sides 86 and 88 of the truck plate may be rolled in the direction of the platform, as shown in FIG. 8. The truck plate may include a small section 87 near the second end 42 of the truck plate which is at an angle to the rest of the truck plate, for contact with the top out stop 104 of the first projection. Note that the shock absorber 18 has been omitted from FIG. 8 for clarity.

The shock absorber 18 has a proximal end 54 and a distal end 56, as shown in FIGS. 2–3. The proximal end 54 of the shock absorber 18 is attached to the central section 32 of the base plate 14. The distal end 56 of the shock absorber is attached to the inner surface 40 of the truck plate 16. If the truck plate is angled as in FIG. 3, the first section 51 is attached to the second end of the shock absorber.

Suitable shock absorbers 18 are well known in the art. A single shock absorber is preferred; preferably no more than two shock absorbers are included. The shock absorber 18 has a biasing means for biasing the truck plate 16 away from the base plate 14. The shock absorber may include a spring as the biasing means. A coil spring 58 is preferred, as shown in FIGS. 1–2 and 4. However, a leaf spring is also acceptable. Alternatively the shock absorber may have an air or gas spring 60, as shown in FIGS. 3 and 6. A combined air/oil shock may be used. The biasing means may also be an elastomeric spring, such as a rubber or urethane bumper or other compressible material.

Preferably the travel of the shock absorber 18 is 1 inch or less, most preferably ¾ inch or ½ inch or less. A long-travel shock absorber tends to place the platform 17 too far from the ground, leading to instability and falls. Since the shock absorber 18 is close to the ground in use, it is preferably covered with a boot (not shown) to protect it from dirt. If an air spring is used, it may be charged with ordinary air or with compressed nitrogen. An air spring is generally lighter in weight than a coil spring and is often easier to adjust. Coil springs are typically more durable and less likely to require maintenance.

The response of the shock absorber may be tunable with an adjusting means. The adjusting means allows the shock absorber to be made stiffer or softer as desired by the rider. The adjusting means may be an adjusting screw 61, as shown in FIG. 6. The adjusting means may be similar to that found in the SID shock absorber, available from Rock Shox.

Another adjusting means may be a series of attachment points for the ends of the shock absorber. This allows the angle of the shock absorber and also its travel and stiffness to be adjusted. For example, the truck plate may include a series of three holes 63 at various distances from the hinge. See FIG. 8. The distal end 56 of the shock absorber may attach to an adapter which may fit into any one of the three holes 63. A similar series of holes 63 may be used for attachment of the proximal end 54 to the base plate.

The shock absorber may also be pivotally attached to the base plate and the truck plate by a pair of shock pins 62. See FIGS. 1 and 3. The shock pins 62 pass through shock pin apertures 64 in connectors 65 at each end 54 and 56 of the shock absorber. See FIG. 3. The shock pins 62 connect to corresponding openings 66 in the base plate and the truck plate. The distance between the openings 66 of the base plate preferably corresponds to the width of each connector 65, so that the connectors are securely held. See FIG. 1. The same is true of the distance between the openings 66 of the truck plate. The pivotal connection allows the shock absorber to be placed at various angles to the truck plate and the base plate, and adapts to changing angles as the shock absorber travels on hitting a bump.

The suspension assembly 10 may be used in various configurations on a skateboard 12. The skateboard 12 may include a single suspension assembly. For example, a suspension unit may be attached between one truck and the platform on the tail end of the skateboard, with the second truck being attached directly to the platform at the front end. However, it is preferred that front and rear suspension assemblies 19 and 21 be used. The front and rear suspension assemblies are located at the front and tail ends 24 and 26 of the skateboard respectively, as shown in FIG. 1. Two suspension assemblies allow for more consistent steering and an even platform slope.

Each suspension assembly may be placed facing either forward or backward. For the embodiments of FIGS. 1–5 and 8, the preferred orientation is to have the second end 30 of the base plate of each of the front and rear suspension assemblies located near the front end and the tail end of the platform respectively. This orientation is shown in FIG. 4 for the rear suspension assembly 21; the front suspension assembly is a mirror image. In this orientation each of the first projections 20 faces inward. Since the outer edge of the projection aids in executing stunts, it is helpful to have the projection closer to the center of gravity of the rider's body. Alternatively, the first end 28 of the base plate of each of the front and rear suspension assemblies may be located near the front end and the tail end of the platform respectively.

The truck 22 has two wheels 68 and a body. The truck is generally conventional in design. The body is attached to the truck plate near the second end 42, opposite the shock absorber. Each wheel is rotatably attached to the body. The body typically consists of an attachment plate 70 and a yoke 72. See FIG. 2. The attachment plate 70 is generally planar and has a cup 74 and a pivot point 76, as shown in FIG. 1. The yoke 72 has a joint end 78, a pivot end 80, and two wheel ends 81. See FIG. 2. A pivot pin 82 extends through the joint end 78 of the yoke. The joint end 78 of the yoke 72 is pivotally attached to the cup 74. See FIG. 1. The pivot end 80 of the yoke 72 is pivotally attached to the pivot point 76 of the attachment plate 70. Each wheel 68 is attached to one of the wheel ends 81.

The trucks 22 may face either forward or backward. Preferably the joint end 78 of the yoke of each truck 22 faces inward, as shown in FIG. 1. In this configuration, the pivot end 80 of each yoke is near the front or tail end of the platform. This allows for better steering control.

The attachment plate 70 is fixedly attached to the truck plate, so that lateral weight shifts of the rider are transmitted directly to the attachment plate. This allows the skateboard to be steered in the conventional manner by tilting the platform with respect to the wheels. Fine steering control is retained.

In a preferred embodiment of the invention the truck plate 16 has an outer surface 84 opposite the inner surface 40 near the second end 42. See FIGS. 1–3 and 8. In this embodiment the body of the truck 22 is attached to the outer surface 84 of the truck plate. The attachment plate 70 may attach to the truck plate with two or more bolts 35, preferably four bolts. See FIG. 2. In a conventional skateboard, the attachment plate 70 connects directly to the bottom surface of the platform 17. In the preferred embodiment of the invention, the attachment plate instead connects to the truck plate, with the suspension between the truck and the platform.

The truck plate preferably has either four or six holes 85 which align with the holes in a standard skateboard truck. This embodiment has the advantage of allowing the use of a standard, unmodified skateboard truck. The standard four holes in the truck can be used without alteration to attach to the truck plate. The suspension, consisting of the base plate, the truck plate, and the shock absorber, can be provided in kit form. Skateboard owners can then use the kit to modify a preexisting skateboard, using the original trucks.

In an alternative embodiment, shown in FIG. 4, the body of the truck 22 is integrally attached to the truck plate 16. The attachment plate 70 is therefore molded in a single piece with the truck plate. This embodiment has the advantage of being lightweight and having relatively few parts.

Figure 5:
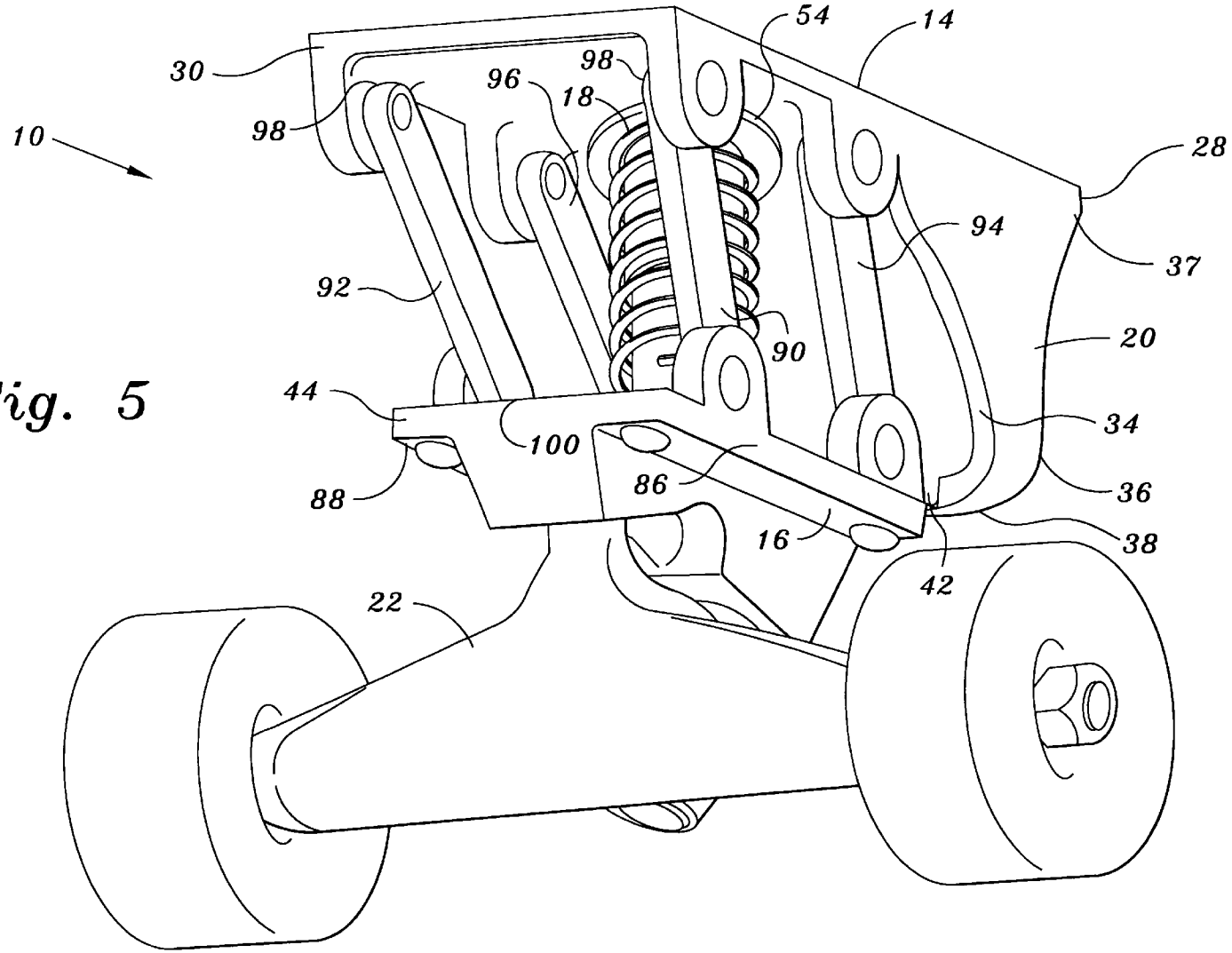
FIG. 5 is a perspective view of a suspension assembly having a 4 bar link system.

FIG. 5 shows another preferred embodiment of the suspension assembly. In this embodiment the truck plate 16 has a first side 86 and an opposite second side 88. The suspension assembly includes a first, a second, a third, and a fourth hinge bar 90, 92, 94, and 96. Each hinge bar has a proximal end 98 and a distal end 100. The proximal end 98 of each hinge bar is pivotally attached to the base plate 14. The distal end 100 of each hinge bar is pivotally attached to the truck plate 16. The first and second hinge bars 90 and 92 are attached to the truck plate near the first end 44 of the truck plate. The third and fourth hinge bars 94 and 96 are attached to the truck plate near the second end 42 of the truck plate. The first and third hinge bars 90 and 94 are attached to the truck plate near the first side 86 of the truck plate. The second and fourth hinge bars 92 and 96 are attached to the truck plate near the second side 88 of the truck plate.

The hinge bars 90, 92, 94, and 96 may have a variety of designs. Each hinge bar may be a flat steel bar which is hinged at each end. This design is lightweight and durable.

The embodiment of FIG. 5 allows the truck plate 16 to remain parallel or generally parallel to the platform 17 as it travels in response to shock. This contrasts to the embodiment of FIGS. 1–4 and 8, in which the truck plate moves in an arc, with one end remaining stationary while the other end moves through space.

Figure 7:
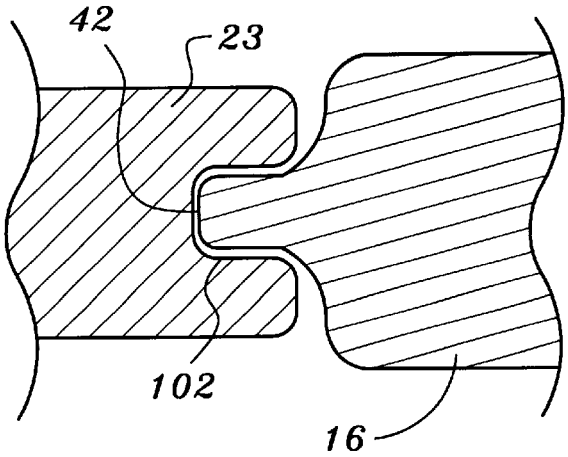
FIG. 7 is a cross-sectional, detail view of a projection fitting into a groove, taken along line 7 of FIG. 6.

FIG. 6 shows an embodiment of the suspension assembly 10 in which the truck plate 16 is not pivotally attached. Instead, the suspension assembly has a first projection 20 and a second projection 23. The first and second projections 20 and 23 are attached to the first and second ends 28 and 30 of the base plate respectively. Each of the first and second projections has an outer edge 36 and an inner edge 34. Each inner edge 34 has a groove 102; see FIG. 7. Each inner edge 34 also has a top out stop 104. The first and second ends 44 and 42 are adjacent to the first and second projections 20 and 23 respectively. Each of the first and second ends 44 and 42 is adapted to slide in one of the grooves 102. The shock absorber 18 is preferably attached to the truck plate 16 approximately half-way between the first and second ends to maintain balance.

The top out stops 104 prevent the truck plate 16 from extending too far from the platform 17. When the truck 22 receives a shock, the truck plate travels vertically toward the platform. The truck plate remains parallel or generally parallel to the platform as it travels. The shock absorber 18 absorbs the shock and stops the travel of the truck plate. During recovery, the shock absorber pushes the truck plate away from the platform until halted by the top out stops 104 at each end.

In any of the embodiments, the suspension assembly 10 provides several benefits in both normal skateboarding and competitive skateboarding. Landings are cushioned by the suspension, which is particularly helpful for jumps and ramps. Injuries to riders are reduced, particularly to the knees. The suspension also decreases friction by decreasing the amount of the rider's momentum lost in hitting bumps, which allows for faster speeds. The suspension also may be adjusted to provide a slight bounce on landing, which may be used to good effect in performing unusual maneuvers.

It is to be understood that the present invention is not limited to the sole embodiments described above, but encompasses any and all embodiments within the scope of the following claims.

I claim:

1. A suspension assembly for a skateboard, the suspension assembly comprising:

(a) a base plate having a first end, a second end, and a central section;

(b) a first projection and a second projection, the first and second projections being attached to the first and second ends of the base plate respectively, each of the first and second projections having an outer edge and an inner edge, each inner edge having a groove and a top out stop;

(c) a truck plate having an inner surface, a first end, and a second end, the first and second ends being adjacent to the first and second projections respectively, each of the first and second ends being adapted to slide in one of the grooves; and (d) a shock absorber having a proximal end and a distal end, the proximal end of the shock absorber being attached to the central section of the base plate, the distal end of the shock absorber being attached to the inner surface of the truck plate, the shock absorber having a biasing means for biasing the truck plate away from the base plate.

2. The suspension assembly according to claim 1, further comprising a truck having a body and two wheels, the body being attached to the truck plate near the second end, each wheel being rotatably attached to the body.

3. The suspension assembly according to claim 1, wherein the shock absorber includes an adjusting means for adjusting the stiffness of the shock absorber.

4. A suspension assembly for a skateboard, the suspension assembly comprising:

(a) a base plate having a first end, a second end, and a central section;

(b) at least a first projection attached to the base plate near the first end of the base plate, the first projection having a concave outer edge;

(c) a truck plate having an inner surface, a second end, and a first end, the second end of the truck plate being located near the first projection, the first end of the truck plate being pivotally connected to the base plate near the second end of the base plate; and (d) a shock absorber having a proximal end and a distal end, the proximal end of the shock absorber being attached to the central section of the base plate, the distal end of the shock absorber being attached to the inner surface of the truck plate, the shock absorber having a biasing means for biasing the truck plate away from the base plate.

5. The suspension assembly according to claim 4, further comprising a truck having a body and two wheels, the body being attached to the truck plate near the second end of the truck plate, each wheel being rotatably attached to the body.

6. The suspension assembly according to claim 4, wherein the distal end of the shock absorber is attached to the inner surface of the truck plate near the second end of the truck plate, and the second end of the truck plate is adapted to travel in an arc.

7. The suspension assembly according to claim 4, wherein the truck plate has a first side and an opposite second side, and further comprising a first, a second, a third, and a fourth hinge bar, each hinge bar having a proximal end and a distal end, the proximal end of each hinge bar being pivotally attached to the base plate, the distal end of each hinge bar being pivotally attached to the truck plate, the first and second hinge bars being attached to the truck plate near the first end of the truck plate, the third and fourth hinge bars being attached to the truck plate near the second end of the truck plate, the first and third hinge bars being attached to the truck plate near the first side of the truck plate, the second and fourth hinge bars being attached to the truck plate near the second side of the truck plate.

8. The suspension assembly according to claim 4, wherein the truck plate has an outer surface opposite the inner surface, and the body of the truck is attached to the outer surface of the truck plate.

9. The suspension assembly according to claim 4, wherein the body of the truck is formed integrally with the truck plate.

10. The suspension assembly according to claim 4, wherein the truck plate has a first section and a second section, the first section is adapted to extend generally parallel to the platform, the first section is attached to the distal end of the shock absorber, and the second section extends at an angle to the first section.

11. The suspension assembly according to claim 4, wherein the truck plate has a second section having a concave outer edge.

12. The suspension assembly according to claim 4, wherein the shock absorber is selected from the group consisting of: a coil spring, an air spring, a gas spring, a leaf spring, and an elastomeric spring.

13. The suspension assembly according to claim 4, wherein the shock absorber includes an adjusting means for adjusting the stiffness of the shock absorber.

14. The suspension assembly according to claim 4, wherein the base plate includes two hinge ears near the second end of the base plate, the first end of the truck plate includes a hinge pin, the hinge pin has two ends, and each hinge ear is pivotally connected to one of the ends of the hinge pin.

15. The suspension assembly according to claim 4, wherein the first projection has an inner edge, and the inner edge of the first projection has a top out stop.

16. A suspension assembly for a skateboard, the suspension assembly comprising:

(a) a base plate having a first end, a second end, and a central section;

(b) at least a first projection attached to the base plate near the first end of the base plate, the first projection having an outer edge;

(c) a truck plate having an inner surface, a second end, and a first end, the second end of the truck plate being located near the first projection, the first end of the truck plate being pivotally connected to the base plate near the second end of the base plate; and (d) a shock absorber having a proximal end and a distal end, the proximal end of the shock absorber being attached to the central section of the base plate, the distal end of the shock absorber being attached to the inner surface of the truck plate near the second end of the truck plate, and the second end of the truck plate is adapted to travel in an arc, the shock absorber having a biasing means for biasing the truck plate away from the base plate.

* * * * *